United States Patent [19]

Garcia

[11] 4,272,220

[45] Jun. 9, 1981

[54] DRUM LIFTER FOR FORK LIFT TRUCK

[75] Inventor: Jose M. Garcia, Miami, Fla.

[73] Assignee: Equipment Company of America, Hialeah, Fla.

[21] Appl. No.: 35,883

[22] Filed: May 4, 1979

[51] Int. Cl.[3] ..... B66F 9/18

[52] U.S. Cl. ..... 414/607; 414/911; 414/620; 414/621; 414/785; 294/87 R; 294/90

[58] Field of Search ..... 414/607, 618–621, 414/623, 664–671, 785, 911; 294/87 R, 90

[56] References Cited

U.S. PATENT DOCUMENTS

| | | | |
|---|---|---|---|
| 2,497,118 | 2/1950 | Ferrario et al. | 414/620 |
| 2,827,189 | 3/1958 | Knudstrup | 414/607 |
| 2,842,275 | 7/1958 | Kughler | 414/621 |
| 2,948,428 | 8/1960 | Kughler | 414/621 |
| 3,172,693 | 3/1965 | Hansen | 414/621 X |
| 3,180,512 | 4/1965 | Moss | 414/607 |
| 3,319,815 | 5/1967 | Vik | 414/607 |
| 3,410,431 | 11/1968 | Vik | 414/607 |
| 3,438,669 | 4/1969 | Vik | 414/607 X |
| 3,506,148 | 4/1970 | Vik | 414/620 X |
| 3,971,485 | 7/1976 | Hoppey | 414/607 X |

FOREIGN PATENT DOCUMENTS

| | | | |
|---|---|---|---|
| 1275404 | 10/1961 | France | 414/607 |

*Primary Examiner*—Robert W. Saifer

*Assistant Examiner*—Terrance L. Siemens

*Attorney, Agent, or Firm*—Cullen, Sloman, Cantor, Grauer, Scott & Rutherford

[57] ABSTRACT

A drum lifter comprises a base including a pair of parallel spaced fork tubes adapted for receiving at one end and positioning over a pair of vertically adjustable forks of a lift truck. A support plate spans the other ends of the tubes and mounts thereover a transverse support pipe with spaced stops thereon. A pair of spaced sleeves are mounted upon the pipe between the stops, each sleeve having an upright jaw support plate secured thereto. A pair of laterally spaced opposed arcuate drum-engaging jaws project forwardly from the sleeves and are pivotally mounted upon the jaw support plates for rotation upon vertical axes. A stop plate is mounted on and extends laterally outward of each jaw and is engageable with the support plate when the jaws are in a horizontal position for holding the jaws to operatively clamp a drum therebetween. The jaws are adapted for outward opening movement for encompassing a drum, after the jaw support plates have been rotated upwardly on a horizontal axis disengaging the stop plates from the support plate. A modified drum lifter includes an elongated stop plate spaced between the jaws and opposed thereto whereby a pair of drums of the same or a different diameter may be gripped and lifted.

27 Claims, 7 Drawing Figures

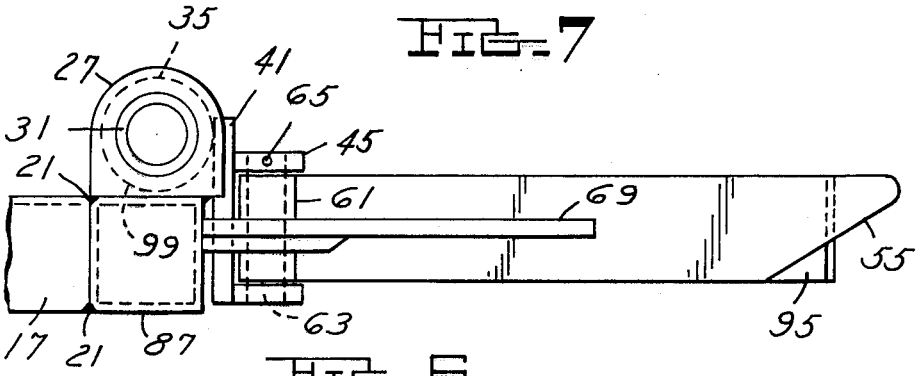
FIG. 7
FIG. 6
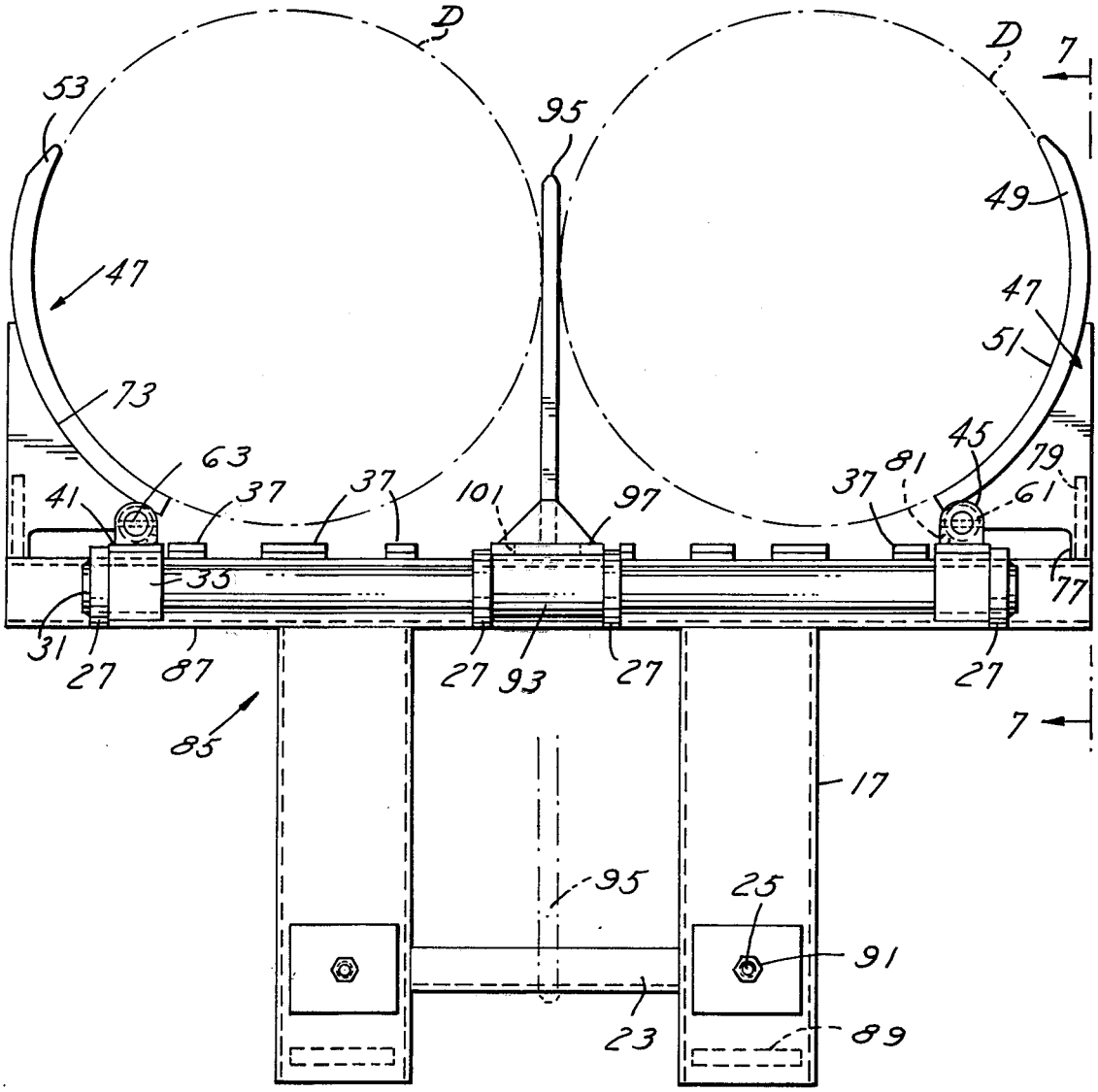

DRUM LIFTER FOR FORK LIFT TRUCK

BACKGROUND OF THE INVENTION

Heretofore, various types of trucks have been designed for lifting drums and supporting the same over a floor surface. Illustrative of such prior art devices are the following U.S. Pat. Nos.: 1,798,565, 3,677,436, 2,787,509, 2,733,074, 2,797,832, 2,793,868, 3,263,822, 2,823,921, 3,438,523, 2,922,658, 3,576,333.

Most of these devices are directed to truck constructions which are manually movable over the ground surface and have manually operable control devices for grasping a drum and lifting the same.

SUMMARY OF THE INVENTION

It is a feature of the present invention to provide an improved drum lifter particularly adapted for fork lift trucks and wherein, the drum lifter mechanism is adapted for reception over the vertically adjustable forks of such a truck and includes at least a pair of opposed drum-engaging jaws which are capable of pivotal movement about horizontal and vertical axes for encompassing and gripping a drum for transport by the truck.

It is another feature to provide a drum lifter for fork lift trucks adapted for use as attachment to the forks of a lift truck and is provided with a pair of opposed drum-gripping jaws in the range wherein, a single drum or a pair of drums of the same or different sizes may be gripped between the jaws and conveniently transported.

These and other features will be seen from the following specification and claims in conjunction with the appended drawings.

THE DRAWING

FIG. 6 is a plan view of a modified drum lifter.

FIG. 7 is a fragmentary right side elevational view of the modified drum lifter taken in the direction of arrows 7—7 of FIG. 6.

It will be understood that the above drawings illustrate merely preferred embodiments of the invention, and that other embodiments are contemplated within the scope of the Claims hereafter set forth.

DETAILED DESCRIPTION OF THE INVENTION

Figure 1:
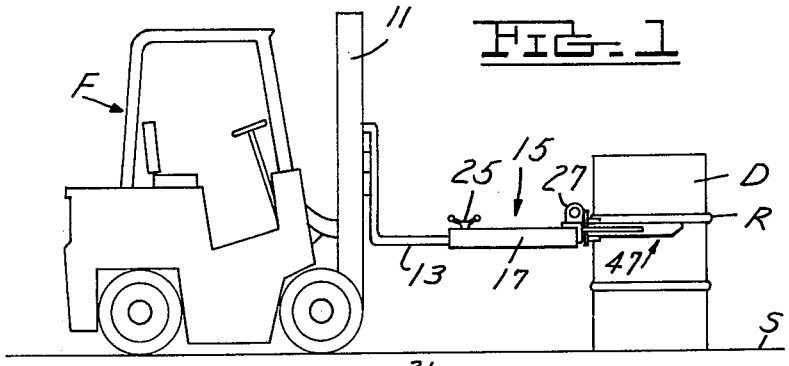
FIG. 1 is a side elevational view of the present drum lifter connected to a pair of forks of a fork lift truck, schematically shown.
Figure 2:
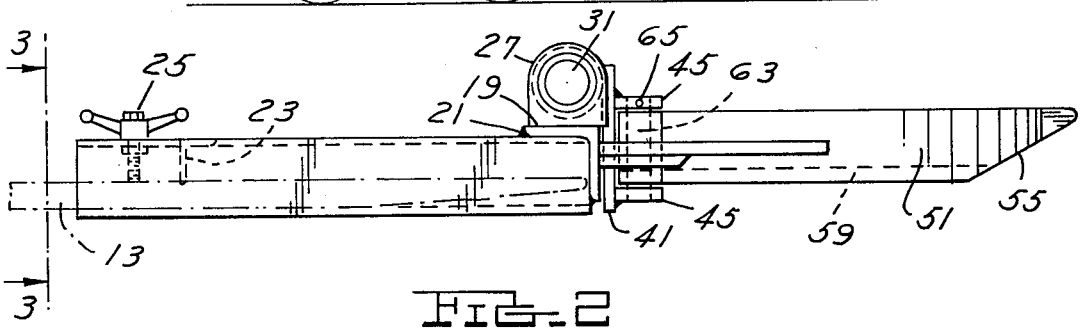
FIG. 2 is a side elevational view of the drum lifter of FIG. 1, shown on an increased scale with a portion of the forks fragmentarily shown.

Referring to the drawings, FIG. 1, a fork lift truck is schematically illustrated at F mounted upon support surface S having a conventional elevator construction 11 for controlling vertical adjustments of a pair of forwardly extending spaced forks 13 such as shown in dash lines in FIG. 2. The present drum lifter 15 is particularly adapted for gripping and lifting 30 or 55 gallon drums designated at D and which have the conventional longitudinally spaced ribs R.

The present drum lifter 15 comprises a base which includes a pair of parallel spaced metallic fork tubes 17 adapted for receiving at one end and positioning over a pair of vertically adjustable forks 13 of lift truck F. Transverse support plate 19 in the form of an angle plate spans, overlies and is secured to the ends of the tubes 17 as by the welds 21, FIG. 2. The base also includes the transverse spacer angle plate 23 which extends between fork tube 17 adjacent its other ends and is suitably secured thereto as by welding.

A wing bolt 25 is threaded through entrant ends of each of the fork tubes 17 and is adapted for operative securing engagement with the respective forks 13, FIG. 2.

Figure 4:
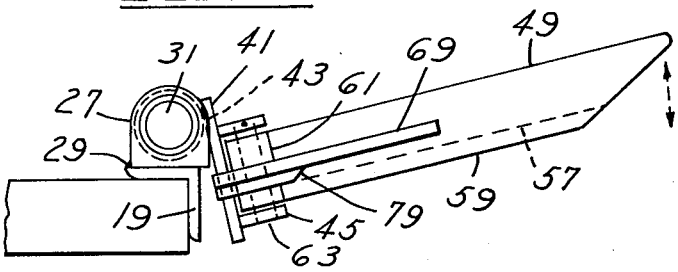
FIG. 4 is a fragmentary side elevational view similar to FIG. 2, illustrating the drum gripping jaws tilted upwardly upon a horizontal axis in order to permit outward opening pivotal movement of the jaws upon vertical axes.

Upright apertured support blocks 27 are mounted upon support plate 19 and secured thereto by welds 29, FIG. 4.

Figure 5:
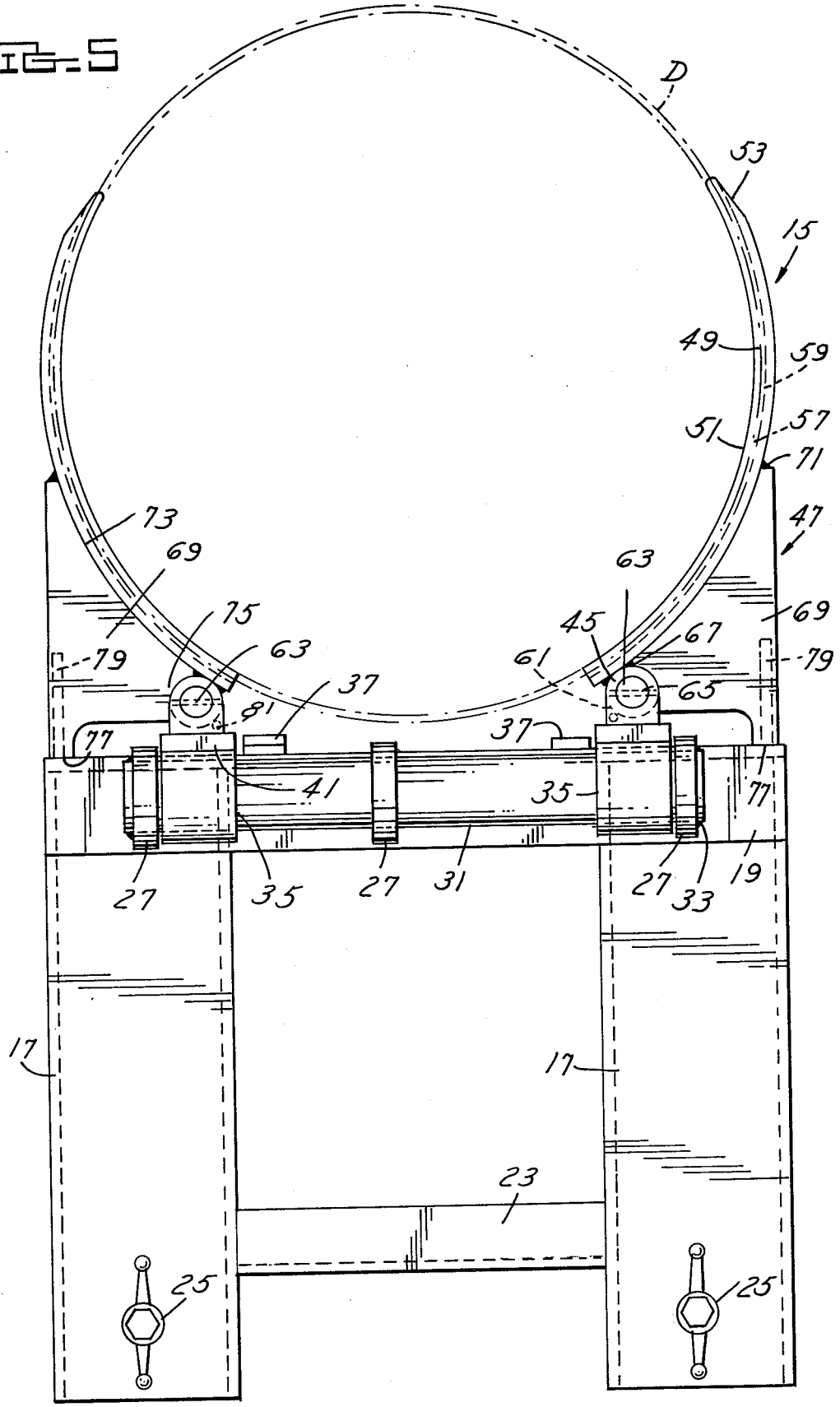
FIG. 5 is a plan view of the drum lifter of FIG. 2 upon a greatly increased scale.

The transverse pipe 31 projects through the respective blocks 27 and is secured thereto by the welds 33. A pair of sleeves 35 are journalled and supported upon pipe 31, FIG. 5, are closely adjacent the blocks 27 and the inwardly spaced stop plates or upright stops 37 which are secured to the support plate 19 for limiting the sleeves 35 against endwise movements upon said pipe.

Thus, the sleeves 35 are adapted for limited rotary movements upon a horizontal axis. The stop plates or stops are shown at 37, FIG. 2, spaced from the blocks 27 and secured to the support angle plate 19 as by welds at 39.

An upright jaw support plate 41 is tangentially secured as by welds 43 to each of the sleeves 35 and depends downwardly therefrom forwardly of support angle plate 19.

A pair of longitudinally spaced trunnions 45 are secured to and project forwardly of plate 41. Each jaw support plate 41 is adapted to pivotally mount a jaw assembly 47, FIG. 5. The jaw assembly 47 includes the forwardly extending arcuate jaw 49 having an arcuate drum-engaging surface 51 with the outer side wall at its outer end being tapered inwardly as at 53.

The forward under surface of the jaw 49 towards its outer end is tapered upwardly and inwardly as at 55, FIG. 2. The inner side wall of the jaw 49 towards its lower longitudinal edge is tapered downwardly and inwardly at 57, FIG. 4 and terminates in an elongated bottom edge 59 of reduced width with respect to the body of the jaw 49.

The jaw assembly 47 includes at the inner end of the jaw 49 transverse pivot sleeve 61 secured to an exterior transverse surface of the jaw 47 at one end as by the weld 67, FIG. 5.

The pivot sleeve 61 is adapted for nesting between a pair of trunnions 45 and is pivotally mounted thereon by the transverse pivot pin 63 which extends through the trunnions 45 and the sleeves 61 and is secured to the upper trunnion as by the transverse lock pin 65. The jaw assembly 47 is pivotally mounted upon the jaw support 41 and is adapted for pivotal adjustments in a vertical plane normally outward from the drum-retaining position shown in FIG. 5.

The jaw assembly 47 also includes upon the exterior thereof and at the pivot end of the jaw 49 intermediate its height stop plate 69, generally triangular in shape and having an inner arcuate surface 73 which is in registry with the jaw 49 and suitably secured thereto as by the welds 71, FIG. 5. Stop plate 69 upon one edge has a transverse notch 66 therethrough so as to extend around jaw pivot sleeve 61. The stop plate 69 has an outer straight edge, FIG. 5, which is substantially tangential to jaw 49 and terminates at its rear end in the stop abutment 77.

In the arrangement shown in FIG. 5 with the respective jaws 47 retainingly engaging drum D, stop abutment 77 is in operative engagement with the front wall of the angle support plate 19. Thus, the stop plates 69 by cam action of the stop abutments 77 against plate 19 compressively and operatively and retainingly engage the drum D therebetween, gripping the drum D for lifting and transport upon the forks 13 of the lift truck F, FIG. 1.

On the under side of the stop plate 69 and as further shown in FIG. 4 there is mounted stop extension 79 whose rear end is in registry with the stop abutment 77 and cooperates therewith in retaining engagement with support 19.

Mounted upon each sleeve 61 and secured thereto is a stop pin 81 which, in the position shown in FIG. 5, is engageable with jaw support plate 41 and thus limits inward movement of the jaws 49 to the position shown in FIG. 5. This is particularly important when no drum is present In the position of the jaw assemblies 47 shown in FIG. 5 and FIG. 2 with the jaws 49 retainingly engaging drum D, the jaws 49 are incapable of outward opening movement since the stop abutments 77 and stop extensions 79 are in operative retaining engagement with support angle plate 19.

In order for the jaws 49 to move outwardly from the gripping position shown or for the purpose of encompassing a drum D standing upon the support surface S, it is first necessary that the jaw assemblies 47 be rotated upwardly upon a horizontal axis such as shown in FIG. 4.

By this construction, with the jaw assembly 47 so tilted upwardly, the stop abutment 77 and the stop extension 79 are no longer in operative engagement with support plate 19. Accordingly, the respective jaw assemblies 47 are adapted for outward rotary movements upon substantial vertical axes and with respect to the support or pivot pins 63, FIG. 4.

In normal operation, as the fork lift truck F approaches the drum D upon support surface S, the tapered end portions 55 of the jaws 49 are brought to bear against opposite side portions of the drum D, just below the first ribs. At that time, the operator of the lift truck lowers the forks 13 a short distance while the truck is moving slowly forward. The jaw assemblies will tilt upwardly to the angular position shown in FIG. 4. This downward movement of the forks 13 also causes the jaw assemblies 47 to swing outwardly a sufficient distance so that the respective jaws 49 encompass then close around the drum D. When the jaws 49 are completely engaged, the forks 13 are raised until the jaws 49 contact the upper ribs R and lift the drum D to the desired height. To release the drum D, the operator lowers the forks 13 until the jaws 49 contact the lower ribs R and start to open, then he backs away.

When the stop abutments 77 are in operative engagement with support plate 19, the jaws 49 are in the drum-gripping position shown in FIG. 5. The jaws 49 are locked in this position as long as the jaw assemblies 47 remain substantially horizontal as in FIGS. 1, 2 and 5 since the stop plate 69 and the stop abutment 77 are functioning to urge the jaws 49 into gripping retaining engagement with the drum d normally below one of the ribs D.

The drum D now gripped may be elevated by the forks 13 and transported to a different location such as a dock or the back of a truck or any desired location. At that time, a limited downward movement of the forks 13 after the drum D is resting upon such support surface S will again cause the jaw assemblies 47 to tilt upwardly to the position shown in FIG. 3 and disengaging the stops 77 and 79 from plate 19. The jaws 49 will automatically swing outwardly disengaging from the drum D.

MODIFIED DRUM LIFTER

A multiple drum lifter for a fork lift truck is generally indicated at 85, FIG. 6, and represents a modification of the drum lifter 15 shown and described with respect to FIG. 1 through 5.

The drum lifter 85 is adapted for gripping one or a pair of drums D which may be of the same diameter or of different diameters.

Much of the construction of the drum lifter base and jaw assembly is the same and a detailed description of the common parts corresponding to FIGS. 1 through 5 will not be repeated in detail.

There are similarly provided for the base of the drum lifter 85 a pair of parallel spaced fork tubes 17 adapted for receiving at one end and positioning over a pair of vertically adjustable forks 13 of a fork lift truck F, FIG. 1. Support plate 87 spans and is secured to the other ends of the tubes 17 corresponding to angle plate 19 of FIG. 2. In this case, however, the support plate 87 is square in cross section.

Similarly, a plurality of apertured support blocks 27 are mounted upon support plate 87 and suitably secured thereto. The transverse pipe 31 is the same as pipe 31 of FIG. 2, though longer, extends through the respective support blocks 27 and is suitably secured thereto. Corresponding stop plates 37 are spaced from the outer support blocks 27 and are suitably secured to the support plate 87. The corresponding sleeves 35 are mounted upon the pipe 31 and bear against the blocks 27 and the adjacent stops 37 and are, therefore, adapted for limited rotary movements upon the pipe 31 upon a horizontal axis.

Each of the sleeves 35 include tangentially secured thereto the corresponding jaw support plate 41, whose construction is exactly the same as above described. The jaw support plate 41 through the corresponding spaced trunnions 45 is adapted to support the respective jaw assemblies 47 which are the same construction as above described.

Since the modified drum lifter 85 is capable of supporting a single drum D, or a pair of drums D, as shown in FIG. 6, which may be of the same or different diameters, such as for a 30 gallon drum or a 55 gallon drum, it is necessary that the sleeves 35 be adapted for longitudinal adjustment upon the pipe 31.

For this purpose, there are provided additional pairs of upright stop plates 37 which are spaced apart and with respect to the stops 37, such that the pipe sleeves 35 may be selectively positioned between any adjacent pair of such stop plates and retained therebetween against unintentional longitudinal movement with respect to the pipe 31.

Transversely mounted upon the interior of each of the fork tubes 17 at the forward ends thereof are the transverse rods 89 suitably secured thereto and adapted for cooperative supporting registry with the forks 13 when inserted within the fork tubes 17.

Wing bolts fragmentarily shown at 25 correspond to the wing bolts 25 of FIG. 5 and are threaded through nuts 91 secured to portions of the tube 17 so that the wing bolts can operatively and compressively engage portions of the forks 13 in the manner shown in FIG. 2 and for effectively securing the modified drum lifter 85 upon the forks 13 with the forks fully projected into the tubes 17 in the manner shown in FIG. 2.

Between a pair of apertured support blocks 27 centrally of the jaws 49 is a sleeve 93 which is mounted upon the pipe 31. Elongated drum-engaging stop plate means 95 at one end is secured as at 97 to sleeve 93 and in the normal drum-engaging position, bears against a suitable stop 101 for retaining the stop plate means 95 in a horizontal position such as shown in FIG. 7 adapted for cooperative retaining engagement with inner surface portions of the respective drums D shown in FIG. 6.

When not in use, or when the drum lifter 85 is to be employed for a single drum D, the stop plate means 95 may be rotated 180 degrees to the dash line position shown in FIG. 6 resting upon the transverse spacer bar 23.

As shown in FIG. 6, since the sleeves 35 must be capable of longitudinal adjustment with respect to the pipe 31, there is formed within each of the sleeves 35 arcuate cut-away portions 99, FIG. 7, such that when the respective sleeves 35 are rotated 90 degrees from the position shown in FIG. 6 and FIG. 7, there will be sufficient clearance opening on the sleeves 35 such that the sleeves 35 may be longitudinally adjusted past the respective upright stationary spacers or stop plates 37 to the required position depending upon the diameter of the drums D to be gripped.

Figure 3:
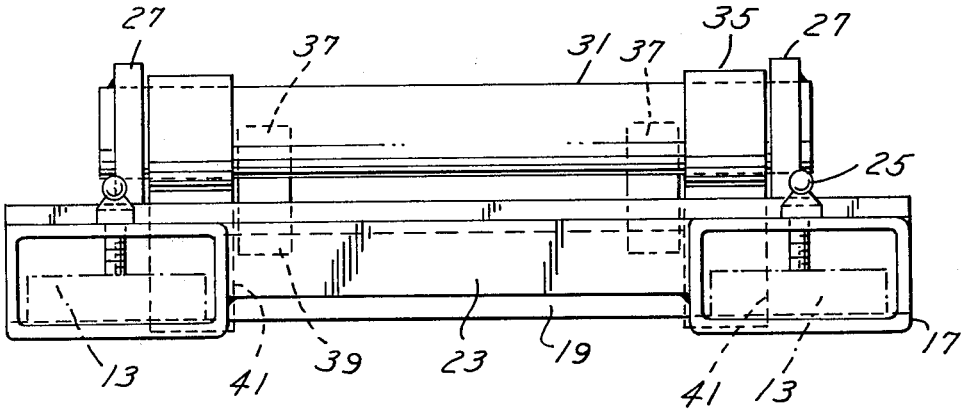
FIG. 3 is an end elevational view taken in the direction of arrows 3—3 of FIG. 2, on an increased scale.

The operation of the multiple drum lifter 85 is the same as above described so that with the jaw assemblies 47 elevated from the horizontal position shown in FIG. 7, such as to the position shown in FIG. 3, upon initial engagement with the drums D, and a downward movement of the forks 13, the jaw assemblies 47 will be rotated to the position shown in FIG. 3. Forward movement of the forks 13 will cause the jaw assemblies 47 once elvated, to swing outwardly to encompass then close around the two drums D with the common inner surfaces thereof retainingly engaged by the stop plate means 95. The forks 13 are elevated until the jaws 49 contact the upper rib R and lift the drums D. The drums D can then be transported by the lift truck F in a conventional manner.

The disengagement, after transportation of the drums D to a particular point, is the same as above described.

Having described my invention, reference should now be had to the following claims.

I claim:

1. A drum lifter comprising a base including a pair of parallel spaced fork tubes adapted for receiving at one end and positioning over a pair of vertically adjustable forks of a lift truck, and a support plate spanning and secured to the other ends of said tubes;

spaced apertured support blocks mounted upon said support plate;

a pipe extending through a secured to said blocks;

upright stops on said support plate spaced from said support blocks respectively;

a pair of spaced sleeves journalled upon said pipe between a support block and an adjacent stop adapted for limited rotation upon a horizontal axis;

an upright jaw support plate tangentially secured to each sleeve for rotation therewith;

a pair of laterally spaced opposed arcuate drum-engaging jaws projecting forwardly of said sleeves respectively and pivotally mounted at one end upon said jaw support plates adapted for rotation upon vertical axes;

a stop plate mounted on and extending laterally outward of each jaw adjacent its pivot end and including a rearwardly extending stop abutment engageable with said support plate when said jaws are in a horizontal position holding said jaws in operable clamping engagement with a drum therebetween;

said jaws adapted for outward opening movement for encompassing or releasing a drum after the jaw plates have been rotated upwardly, disengaging said stop abutments from said support plate;

return of said jaw support plates to upright position, causing said stop plates to move said jaws inwardly gripping the drum;

the pivotal mounting of said jaws including a pair of spaced trunnions upon each jaw support plate;

a jaw sleeve mounted on one end of each jaw extending transversely thereof and nested between said pair of trunnions; and a pivot pin extending through said jaw sleeve, and through said trunnions and secured thereto; and a stop pin extending longitudinally of each jaw sleeve and secured thereto, adapted for operative engagement with the adjacent jaw support plate limiting inward movement of said jaws respectively.

2. In the drum lifter of claim 1, a wing bolt adjustably threaded into an end portion of each fork tube for operative retaining engagement with the forks.

3. In the drum lifter of claim 2, said fork tubes being rectangular in cross section;

with the forks being similarly shaped for snug cooperative securing within said fork tubes.

4. In the drum lifter of claim 1, a reinforcing angle plate interposed between said fork tubes adjacent their said one ends and secured thereto.

5. In the drum lifter of claim 1, said jaw stop being generally triangular, having an outer edge substantially tangential to the adjacent jaw and extending at right angles to said support plate, and coextensive with the stop on said stop plate.

6. In the drum lifter of claim 1, said jaw stop plate being secured to said jaw adjacent its pivot end and arranged intermediate the high of said jaw.

7. In the drum lifter of claim 6, the lowering of said forks a limited amount after the drum is resting upon a support surface, causing said jaw support plates to tip upwardly disengaging said stop plates from said support plate and permitting outward disengaging movement of said jaws about said vertical axes.

8. In the drum lifter of claim 1, forward movement of said jaws into contact with a drum standing upon a support surface, and lowering said forks, causing said jaw support plates to tip upwardly disengaging said stop plates from said support plate;

said drum camming said jaws outwardly to encompass said drum on forward movement of said forks.

9. In the drum lifter of claim 1, said support plate being angular in shape and overlying the tops and end portions of said fork tubes.

10. In the drum lifter of claim 1, said support plate being a tube of rectangular cross section.

11. In the drum lifter of claim 1, there being at least a pair of spaced annular ribs upon said drum with said jaws supportably underlying one of said ribs.

12. A drum lifter comprising a base including a pair of parallel spaced fork tubes adapted for receiving at one end and positioning over a pair of vertically adjustable forks of a lift truck, and a support plate spanning and secured to the other ends of said tubes;

spaced apertured support blocks mounted upon said support plate;

a pipe extending through and secured to said blocks;

upright stops on said support plate spaced from said support blocks respectively;

a pair of spaced sleeves journalled upon said pipe between a support block and an adjacent stop adapted for limited rotation upon a horizontal axis;

an upright jaw support plate tangentially secured to each sleeve for rotation therewith;

a pair of laterally spaced opposed arcuate drum-engaging jaws projecting forwardly of said sleeves respectively and pivotally mounted at one end upon said jaw support plates adapted for rotation upon vertical axes;

a stop plate mounted on and extending laterally outward of each jaw adjacent its pivot end and including a rearwardly extending stop abutment engageable with said support plate when said jaws are in a horizontal position holding said jaws in operable clamping engagement with a drum therebetween;

said jaws adapted for outward opening movement for encompassing or releasing a drum after the jaw support plates have been rotated upwardly, disengaging said stop abutments from said support plate;

return of said jaw support plates to upright position, causing said stop plates to move said jaws inwardly gripping the drum; said jaws adapted to receive therebetween a pair of drums side by side;

and an elongated stop plate means spaced inwardly of said jaws, at one end pivotally mounted upon said pipe and extending forwardly adapted to operatively and retainingly engage inner portions of said pair of drums in cooperation with said jaws.

13. In the drum lifter of claim 12, the pivotal mounting of said stop plate means including a sleeve journalled upon said pipe;

and a pair of spaced apertured blocks upon said support plate receiving said pipe and retainingly engaging said sleeve against endwise movements;

said stop plate means adapted for rotation 180 degrees out of opposing registry with said jaws to an inoperative position.

14. In the drum lifter of claim 13, said jaws adapted for longitudinal adjustment along said pipe for selectively receiving a single drum, when said stop plate means is in an inoperative position.

15. In the drum lifter of claim 12, additional spaced upright stops upon said support plate along the length of said pipe, spaced from said first stops and from each other whereby, said pipe sleeves are adapted for longitudinal adjustment along said pipe and selectively interposed between a pair of adjacent stops for regulating the distance between said jaws and said stop plate means so that said jaws may accommodate drums of the same, reduced or different diameters, there being a clearance slot formed in said pipe sleeves whereby, on rotation thereof approximately 90° they may be slid longitudinally along said pipe free of said stops.

16. A drum lifter adapted for attachment to a lifting device comprising a base including a support plate;

spaced apertured support blocks mounted upon said support plate;

a pipe extending through and secured to said blocks;

upright stops on said support plate spaced from said support blocks respectively;

a pair of spaced sleeves journalled upon said pipe between a support block and an adjacent stop adapted for limited rotation upon a horizontal axis;

an upright jaw support plate tangentially secured to each sleeve for rotation therewith;

a pair of laterally spaced opposed arcuate drum-engaging jaws projecting forwardly of said sleeves respectively and pivotally mounted at one end upon said jaw support plates adapted for rotation upon vertical axes;

a stop plate mounted on and extending laterally outward of each jaw adjacent its pivot end and including a rearwardly extending stop abutment engageable with said support plate when said jaws are in a horizontal position holding said jaws in operable clamping engagement with a drum therebetween;

said jaws adapted for outward opening movement for encompassing or releasing a drum after the jaw support plates have been rotated upwardly, disengaging said stop abutments from said support plate;

return of said jaw support plate to upright position, causing said stop plates to move said jaws inwardly gripping the drum;

the pivotal mounting of said jaws including a pair of spaced trunnions upon each jaw support plate;

a jaw sleeve mounted on one end of each jaw extending transversely thereof and nested between said pair of trunnions;

and a pivot pin extending through said jaw sleeve, and through said trunnions and secured thereto; and a stop pin extending longitudinally of each jaw sleeve and secured thereto, adapted for operative engagement with the adjacent jaw support plate limiting inward movement of said jaws respectively.

17. In the drum lifter of claim 16, said jaw stop plate being generally triangular, having an outer edge substantially tangential to the adjacent jaw and extending at right angles to said support plate, and coextensive with the stop on said stop plate.

18. In the drum lfiter of claim 16, said jaw stop plate being secured to said jaw adjacent its pivot end and arranged intermediate the height of said jaw.

19. In the drum lifter of claim 18, the lowering of said base a limited amount after the drum is resting upon a support surface, causing said jaw support plates to tip upwardly disengaging said stop plates from said support plate and permitting outward disengaging movement of said jaws about said vertical axes.

20. In the drum lifter of claim 16, forward movement of said jaws into contact with a drum standing upon a support surface, and lowering said base, causing said jaw support plates to tip upwardly disengaging said stop plates from said support plate;

said drum camming said jaws outwardly to encompass said drum on forward movement of said base.

21. In the drum lifter of claim 6, said support plate being angular in shape.

22. In the drum lifter of claim 16, said support plate being of rectangular cross section.

23. A drum lifter adapted for attachement to a lifting device comprising a base including a support plate;

spaced apertured support blocks mounted upon said support plate;

a pipe extending through and secured to said blocks;

upright stops on said support plate spaced from said support blocks respectively;

a pair of spaced sleeves journalled upon said pipe between a support block and an adjacent stop adapted for limited rotation upon a horizontal axis;

an upright jaw support plate tangentially secured to each sleeve for rotation therewith;

a pair of laterally spaced opposed arcuate drum-engaging jaws projecting forwardly of said sleeves respectively and pivotally mounted at one end upon said jaw support plates adapted for rotation upon vertical axes;

a stop plate mounted on and extending laterally outward of each jaw adjacent its pivot end and including a rearwardly extending stop abutment engageable with said support plate when said jaws are in a horizontal position holding said jaws in operable clamping engagement with a drum therebetween;

said jaws adapted for outward opening movement for encompassing or releasing a drum after the jaw support plates have been rotated upwardly, disengaging said stop abutments from said support plate;

return of said jaw support plates to upright position, causing said stop plates to move said jaws inwardly gripping the drum, said jaws adapted to receive therebetween a pair of drums side by side;

and an elongated stop plate means spaced inwardly of said jaws, at one end pivotally mounted upon said pipe and extending forwardly adapted to operatively and retainingly engage inner portions of said pair of drums in cooperation with said jaws.

24. In the drum lifter of claim 23, the pivotal mounting of said stop plate including a sleeve journalled upon said pipe;

and a pair of spaced apertured blocks upon said support plate receiving said pipe and retainingly engaging said sleeve against endwise movements;

said stop plate means adapted for rotation 180 degrees out of opposing registry with said jaws to an inoperative position.

25. In the drum lifter of claim 24, said jaws adapted for longitudinal adjustment along said pipe for selectively receiving a single drum, when said stop plate means is in an inoperative position.

26. In the drum lifter of claim 23, additional spaced upright stops upon said support plate along the length of said pipe, spaced from said first stops and from each other whereby, said pipe sleeves are adapted for longitudinal adjustment along said pipe and selectively interposed between a pair of adjacent stops for regulating the distance between said jaws and said stop plate means so that said jaws may accommodate drums of the same, reduced or different diameters, there being a clearance slot formed in said pipe sleeves whereby, on rotation thereof approximately 90° they may be slid longitudinally along said pipe free of said stops.

27. A drum lifter adapted for attachment to a lifting device comprising a base including a support plate;

a pair of spaced apertured support blocks mounted upon said support plate;

a pipe extending through and secured to said blocks;

a first upright stop on said support plate spaced adjacent to one of said support blocks and a second upright stop on said support plate spaced adjacent to the other support block respectively;

a pair of spaced sleeves journalled upon said pipe, each sleeve being journalled on said pipe between a support block and an adjacent stop, and each sleeve adapted for independent limited rotation upon a horizontal axis and longitudinal movement along said pipe between a respective support block and adjacent stop;

an upright jaw support plate tangentially secured to each sleeve for rotation therewith;

a pair of laterally spaced opposed arcuate drum-engaging jaws projecting forwardly of said sleeves respectively and pivotally mounted at one end upon said jaw support plates adapted for rotation upon vertical axes;

a stop plate mounted on an extending laterally outward of each jaw adjacent its pivot end and including a rearward extending stop abutment engageable with said support plate when said jaws are in a horizontal position holding said jaws in operable clamping engagement with a drum therebetween;

said jaws adapted for outward opening movement for encompassing or releasing a drum after the jaw support plates have been rotated upwardly, disengaging said stop abutments from said support plate;

return of said jaw support plates to upright position, causing said stop plates to move said jaws inwardly gripping the drum; and said sleeves being adapted for limited longitudinal adjustment along said pipe between a respective support block and adjacent stop for assisting in the movement of the jaws in automatically gripping or releasing a drum.

* * * * *